United States Patent [19]

Uchida et al.

[11] 4,234,002

[45] Nov. 18, 1980

[54] ADJUSTING MEANS FOR MONEY HANDLING MACHINES

[75] Inventors: Isamu Uchida; Kenkichi Watanabe, both of Tokyo, Japan

[73] Assignee: Laurel Bank Machine Co., Ltd., Tokyo, Japan

[21] Appl. No.: 859,463

[22] Filed: Dec. 12, 1977

[30] Foreign Application Priority Data

Dec. 16, 1976 [JP] Japan ..... 51-168475
Dec. 27, 1976 [JP] Japan ..... 51-176247

[51] Int. Cl.[3] ..... B65B 59/00

[52] U.S. Cl. ..... 133/1 A; 133/8 A; 53/212

[58] Field of Search ..... 133/1 R, 1 A, 8 A, 4 R; 221/92, 129; 53/212

[56] References Cited

U.S. PATENT DOCUMENTS 3,899,864 8/1975 Uchida et al. ..... 53/212
4,060,093 11/1977 Douno ..... 133/1 A
4,085,879 4/1978 Nobuhiro ..... 133/1 A X
4,123,892 11/1978 Asami ..... 133/1 A X

FOREIGN PATENT DOCUMENTS 2437223 2/1976 Fed. Rep. of Germany ..... 133/1 A

*Primary Examiner*—Joseph J. Rolla
*Attorney, Agent, or Firm*—Stevens, Davis, Miller & Mosher

[57] ABSTRACT

A money handling machine such as a coin or bill counting, sorting or wrapping machine having an improved adjusting arrangement to switch from one type coin or bill to another. The adjusting arrangement has a manually operated section with a plurality of first and second switches, at least one manually operated switch actuating member having a plurality of money selecting positions and a member for actuating predetermined ones of the first switches in accordance with the position of the actuating member.

2 Claims, 14 Drawing Figures

ADJUSTING MEANS FOR MONEY HANDLING MACHINES

The present invention relates to money handling machines such as coin or bill counting machines, coin packaging machines, bill wrapping machines and coin sorting machines. More particularly, the present invention pertains to adjusting means for such coin handling machines.

Throughout the world, it is not uncommon that several kinds of coins are used in a country so that such coin handling machines are usually provided with adjusting means for accommodating the machine to a specific type of coins as desired. Usually, such adjusting means includes a selector dial which is associated with a switch actuating cam for actuating desired one of a plurality of switches. In conventional machines, such switches are provided in numbers equivalent to the number of types of coins to be handled, so that a large space is occupied by the switches in the adjusting means. Since such switches are also associated with corresponding number of limit switches, a substantial number of such switches are required.

It is therefore an object of the present invention to provide money handling machines having adjusting means wherein a fewer number of switches are required.

Another object of the present invention is to provide money handling machines having a compact and less expensive adjusting means.

A further object of the present invention is to provide money handling machines which can handle a plurality of moneys but less expensive as compared with similar type of conventional machines.

According to the present invention, the above and other objects can be accomplished by money handling machine including adjusting means for accommodating the machine to a desired type of money, said adjusting means comprising a manually operated section which includes a plurality of first switches, manually operated switch actuating member means having a plurality of money selecting positions and means for actuating predetermined ones of the first switches in accordance with the position of said actuating member. The adjusting means also has an operating section including adjustable member means which is movable to a plurality of positions, means for actuating the adjustable member means for accommodating the machine to a desired type of money, second switches corresponding in number to the first switches and being so connected that the second switches co-operate with respective ones of the first switches, means for actuating predetermined ones of the second switches in accordance with the position of the adjustable member means whereby a change in electrical condition is produced when the second switches take predetermined positions with respect to the first switches. The electric signal may be utilized to stop the operation of the adjustable member actuating means and/or to operate indicating means.

According to the present invention, a plurality of first switches are utilized in combination to represent each of the positions of the manually operated switch actuating member means so that it is possible to decrease the number of the first switches. For example, where the first switches are of two-position type, six positions of the manually operated switch actuating member means can be represented satisfactorily only by three switches.

The present invention can be applied to any type of money handling machine. Where the present invention is applied to a coin wrapping machine, the adjustable member means in the operating section may be adjustable members for a coin sorting section, a coin stacking cylinder selector, a wrapping paper selector and/or adjusting means in the wrapping section. Where the present invention is applied to a bill handling machine such as a bill dispensing machine, the adjustable member means may be a bill stacker selector. The present invention can further be applied to other types of machines such as money exchangers, vending machines and the like.

The above and other objects and features of the present invention will become apparent from the following descriptions of preferred embodiments taking reference to the accompanying drawings, in which.

Figure 1:
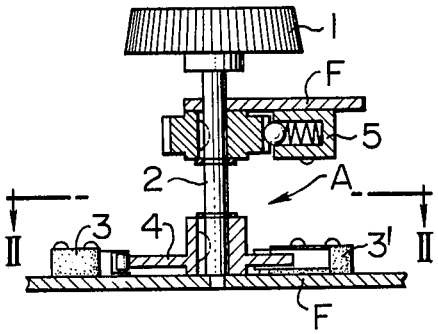
FIG. 1 is a sectional view showing the manually operated section in accordance with one embodiment of the present invention.
Figure 2:
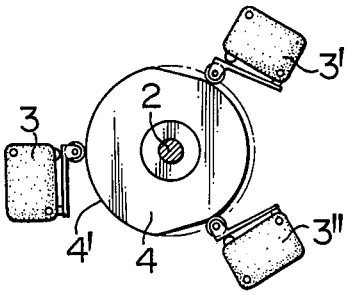
FIG. 2 is a view taken substantially along the line II—II in FIG. 1.

Referring to the drawings, particularly to FIGS. 1 and 2, there is shown a manual selecting device for a coin wrapping machine which includes a selector knob 1 adapted to be rotated to select a desired type of coin. The knob 1 is secured to a shaft 2 which is rotatably supported on a frame F. The shaft 2 is provided with a click-stop mechanism 5 so that the knob 1 can be stopped at any one of predetermined positions. In the specific example, the knob 1 can be stopped at six different positions.

Around the shaft 2, there are positioned three switches 3, 3' and 3'' at circumferentially spaced positions. The shaft 2 has a cam 4 which is secured thereto and formed with a cam lobe 4' for actuating one or two of the switches in accordance with the positions of the knob 1.

Figure 3:
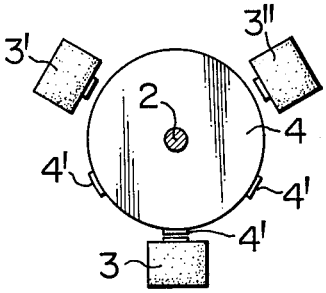
FIG. 3 is a view similar to FIG. 2 but showing another embodiment.

In the arrangement shown in FIG. 3, the shaft 2 is provided with a circular disc 4 which has circumferentially spaced projections 4' for selectively actuating the switches 3, 3' and 3". The switches may be of two-position type having positions 0 and 1 and the three switches take the positions as shown in Table I in accordance with the six position of the knob 1.

TABLE 1

| Knob Position/ Switch No. | 3 | 3' | 3" |
|---|---|---|---|
| 1 | 0 | 1 | 1 |
| 2 | 0 | 0 | 1 |
| 3 | 0 | 1 | 0 |
| 1 | 1 | 0 | 1 |
| 5 | 1 | 0 | 0 |
| 6 | 1 | 1 | 0 |

Figure 4:
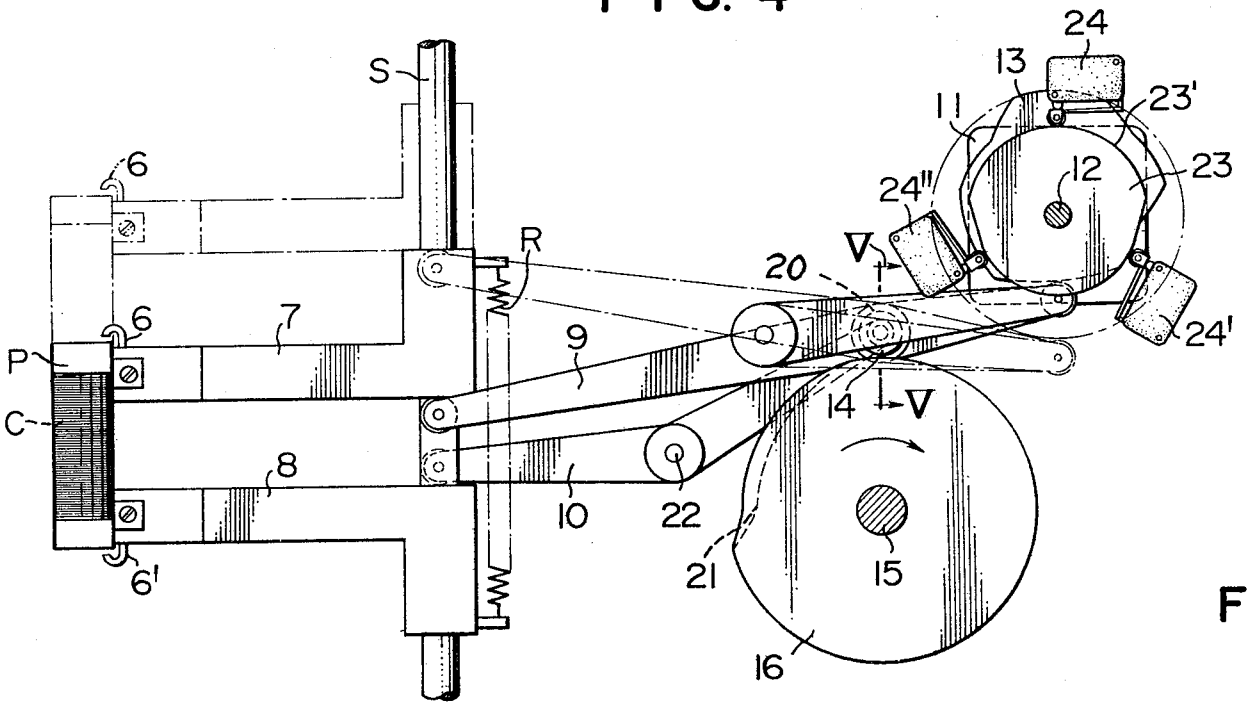
FIG. 4 is a diagrammatical side view showing the coin wrapping section of a coin wrapping machine embodying the feature of the present invention.
Figure 5:
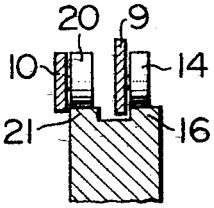
FIG. 5 is a sectional view taken along the line V—V in FIG. 4.

Referring now to FIGS. 4 and 5 which show a coin wrapping mechanism of a coin wrapping machine. As conventional in the art, the mechanism includes a pair of opposed beading fingers 6 and 6' respectively carried by upper and lower arms 7 and 8. As a paper P is wrapped around a stack of coins C, the fingers 6 and 6' engage the opposite edges of the paper P to curl the edges so that beads are formed at the opposite ends of the wrapped coin stack. The mechanism is well known in the art so that a detailed description is not needed.

Since the overall height of the coin stack is different in accordance with the type of coins to be wrapped, the distance between the fingers 6 and 6' must be adjusted. For this purpose, the arms 7 and 8 are supported by a vertical shaft S for sliding movement therealong. A spring R extends between the arms 7 and 8 so as to urge the arms toward each other. A lever 9 is provided for engagement at one end with the arm 7 and another lever 10 is provided to engage at one end with the arm 8.

The other end of the lever 9 is in engagement with a cam 13 which is secured to an output shaft 12 of a motor 11. The lever 9 carries a fulcrum roller 14 at an intermediate portion and the roller 14 is engaged with a cam 16 on a rotatable shaft 15.

The lever 10 is pivotably supported by a shaft 22 and provided at the other end with a roller 20 which is in engagement with a cam 21 on the shaft 15. Thus, in operation, the shaft 15 is continuously rotated and the arms 7 and 8 are cyclically moved up and down so as to bring the fingers 6 and 6' into operative and inoperative positions. When the motor 11 is operated to rotate the cam 13 and a higher lobe on the cam engages the lever 9, the lever 9 is swung about the axis of the roller 14 so that the arm 7 and therefore the finger 6 is moved upwards to a position shown by phantom lines in FIG. 4. Thus, it now becomes possible to handle a taller coin stack.

Around the shaft 12 of the motor 11, there are provided three switches 24, 24' and 24" at circumferentially spaced portions. A cam 23 is secured to the shaft 12 for selectively actuating the switches 24, 24' and 24" in accordance with the angular positions of the shaft 12. The switches 24, 24' and 24" may be of two-position type having first and second positions and correspond respectively to the switches 3, 3' and 3".

Figure 6:
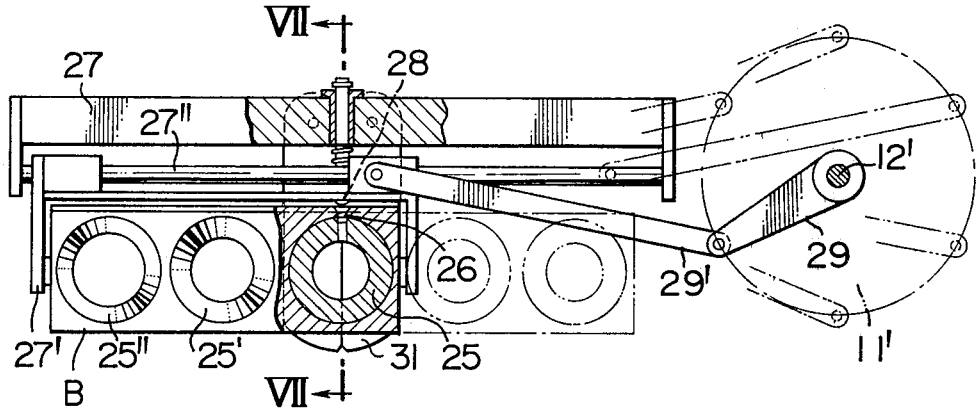
FIG. 6 is a partially sectional plan view of the coin stacker selecting section embodying the feature of the present invention.
Figure 7:
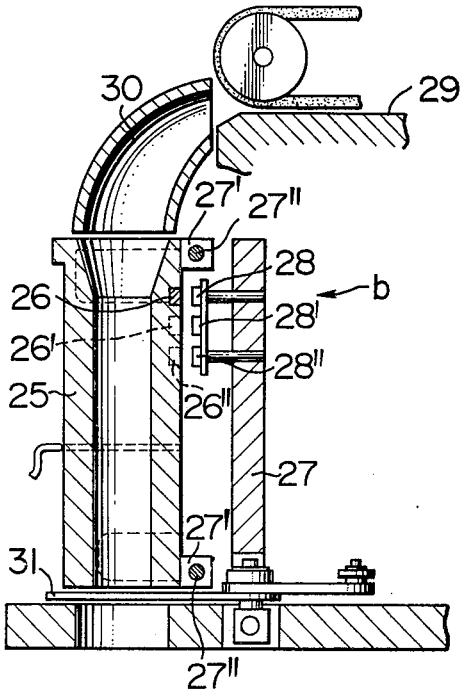
FIG. 7 is a sectional view taken substantially along the line VII—VII in FIG. 6.

Referring now to FIGS. 6 and 7, there is shown a coin stacking cylinder selecting mechanism to which the present invention can be applied. The mechanism includes a cylinder block B having cylinder bores 25, 25' and 25" of different diameters. The cylinder block B is carried on a block holder 27 by means of brakets 27' and guide rods 27" so that it is movable along the guide rods 27". Above the cylinder block B, there is provided a coin chute 30 for receiving coins from a coin channel 29. Beneath the cylinder block B, there is disposed a shutter 31 as is conventional in the art. The cylinder block B is connected through a linkage including links 29 and 29' with an output shaft 12' of a motor 11 so that the block B is moved along the guide rods 27' in response to a rotation of the motor shaft 12' to place selected one of the cylinder bores 25, 25' and 25" beneath the chute 30. At one side of the respective cylinder bores, the cylinder block B is provided with switch actuating pieces 26, 26' and 26" which are located at different heightwise positions and may comprise pieces of permanent magnet or magnetic material. On the holder 27, there are located three proximity switches 28, 28' and 28" at levels respectively corresponding to the actuating pieces 26, 26' and 26". Thus, a predetermined one of the proximity switches 28, 28' and 28" is actuated when corresponding one of the cylinder bores is located beneath the chute 30.

Figure 8:
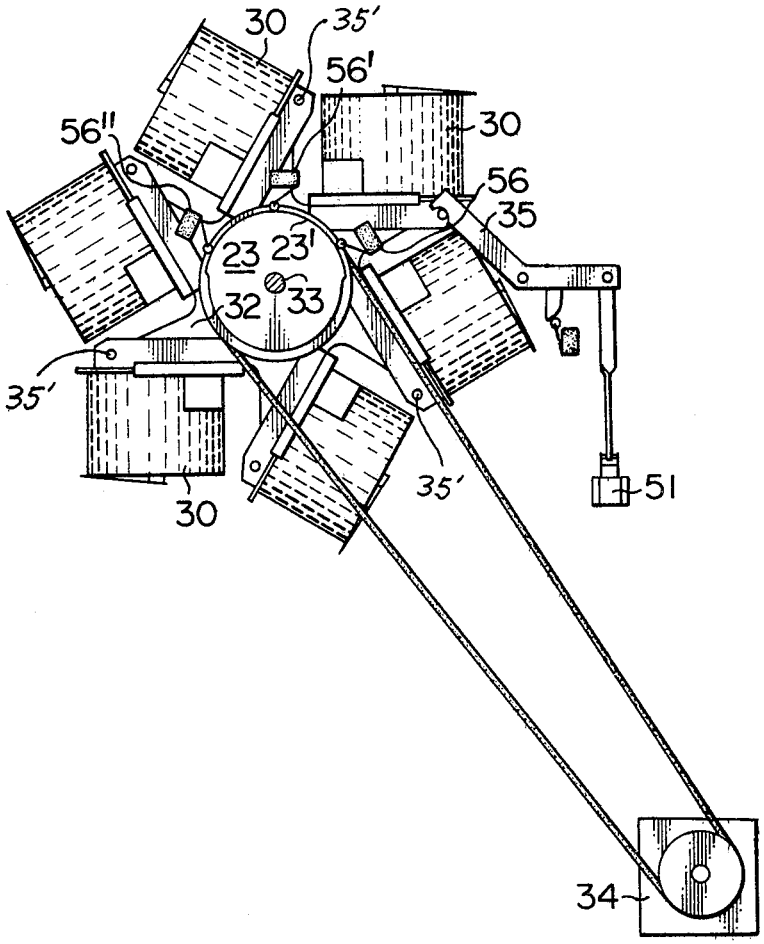
FIG. 8 is à side view of a wrapping paper selecting section embodying the present invention.

FIG. 8 shows an example in which the present invention is applied to a wrapping paper selecting mechanism. Six rolls 30 of different types of wrapping papers are carried on a table 32 which is secured to a rotatable shaft 33 to be actuated by means of a motor 34 through a belt-pulley mechanism. The table 32 or the paper roll support brackets are provided with pins 35' which are adapted to be engaged by a hook member 35 under the action of a locking spring (not shown). For unlocking, a solenoid 51 is provided. On the stationary part of the machine, there are disposed three switches 56, 56' and 56" and a cam 23 is secured to the shaft 33 for selective actuation of the switches 56, 56' and 56". When the motor 34 is energized to rotate the table 32 and one of the paper rolls 30 is moved to an operative position, the unlocking solenoid 51 is de-energized so that the table 32 is locked by the hook 35 under the action of a locking spring (not shown) and the paper in the particular roll is dispensed for use as is well known in the art.

Figure 9:
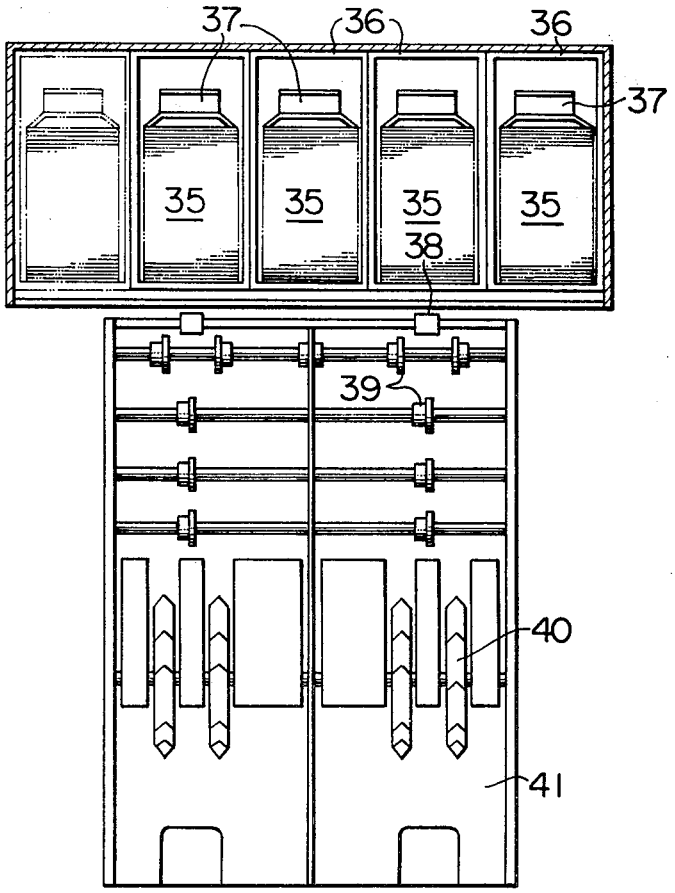
FIG. 9 is a view showing another example of the wrapping paper selecting section to which the present invention can be applied.
Figure 10:
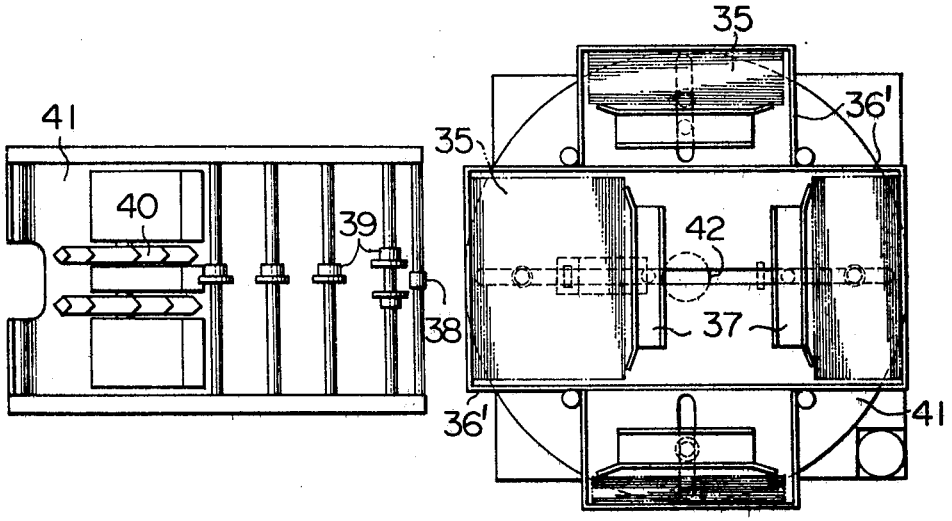
FIG. 10 is a view similar to FIG. 9 but showing another example.

FIG. 9 shows an example of bill dispensing mechanism which includes a plurality of bill stacking racks 36 positioned in a side-by-side relationship above a dispensing path including suction pads 38, feed-out rollers 39 and feed-out wheels 40 of conventional arrangement. A stack of bills 35 is positioned in each rack 36 and forced by a pressing plate 37 toward an outlet. The bill racks 36 are transversely movable so as to have desired one of the racks 36 aligned with one of the suction pads 38. Switches may be provided in this mechanism so as to represent the lateral positions of the racks 36. FIG. 10 shows another type of bill dispensing mechanism in which a plurality of bill stacking racks 36' are mounted on a plate 41 which has a shaft 42 to be rotated by means of a motor. Of course, this mechanism may also be provided with switches as in the previous examples.

Figure 11:
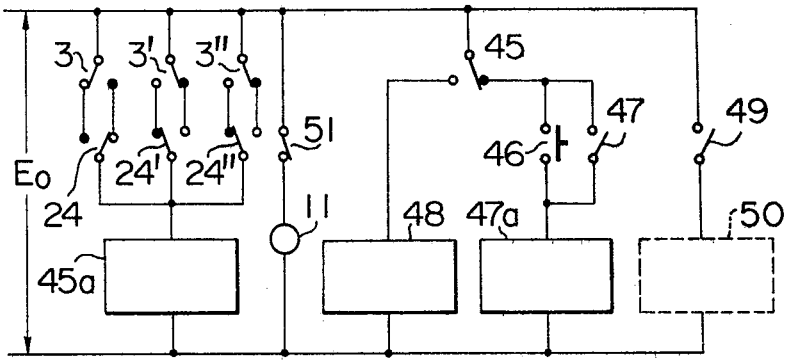
FIG. 11 is a circuit diagram showing an embodiment of the present invention.

Referring now to FIG. 11, the switches 3, 3' and 3" are respectively associated with the switches 24, 24' and 24" which may be the switches as shown in FIG. 4 or 8. The switches 24, 24' and 24" are connected with a solenoid 45*a* of a relay switch 45 which has a normally closed contact connected with an operation start push button switch 46 and a solenoid 47*a* of a relay switch 47 as well as a normally open contact connected with a warning device such as a buzzer 48. The relay switch 47 is in parallel with the push button switch 46 so as to hold the solenoid in an energized condition as far as the relay 45 is in the normal position shown in FIG. 11.

An operating switch 49 is positioned in series with an operating circuit 50 of the machine and adapted to be maintained by the solenoid 47*a*. A switch 51 which is closed upon energization of the solenoid 45*a* is connected in the circuit of an adjusting motor such as the motor 11 shown in FIG. 4.

The positions of the switches 3, 3' and 3'' are determined by the knob 1 through the cam or projections 4' as described with reference to FIGS. 1 through 3 and the switches 24, 24' and 24'' are so arranged that, when the adjustable member such as the finger 6 in FIG. 4 is in the position corresponding to the position of the knob 1, the lines through the switches 3 and 24, 3' and 24', and 3'' and 24'' are opened as shown in FIG. 11, however, when the finger 6 is not correctly positioned, either one or more of the aforementioned lines are closed so that the solenoid 45*a* is energized. Thus, the motor 11 is operated until the finger 6 is moved to a desired position and during the period of operation the buzzer 48 is energized to produce a warning.

As soon as the finger 6 reaches the desired position, all of the aforementioned lines are opened and the solenoid 45*a* is de-energized. Thus, the motor 11 is stopped and the operation of the buzzer 48 is terminated to show that the machine is adjusted for the desired type of coins. Then, the operator may actuate the push button 46 so that the solenoid 47*a* is energized. The switch contact 49 is then closed and the operating circuit 50 is energized to perform the wrapping operation.

Figure 12:
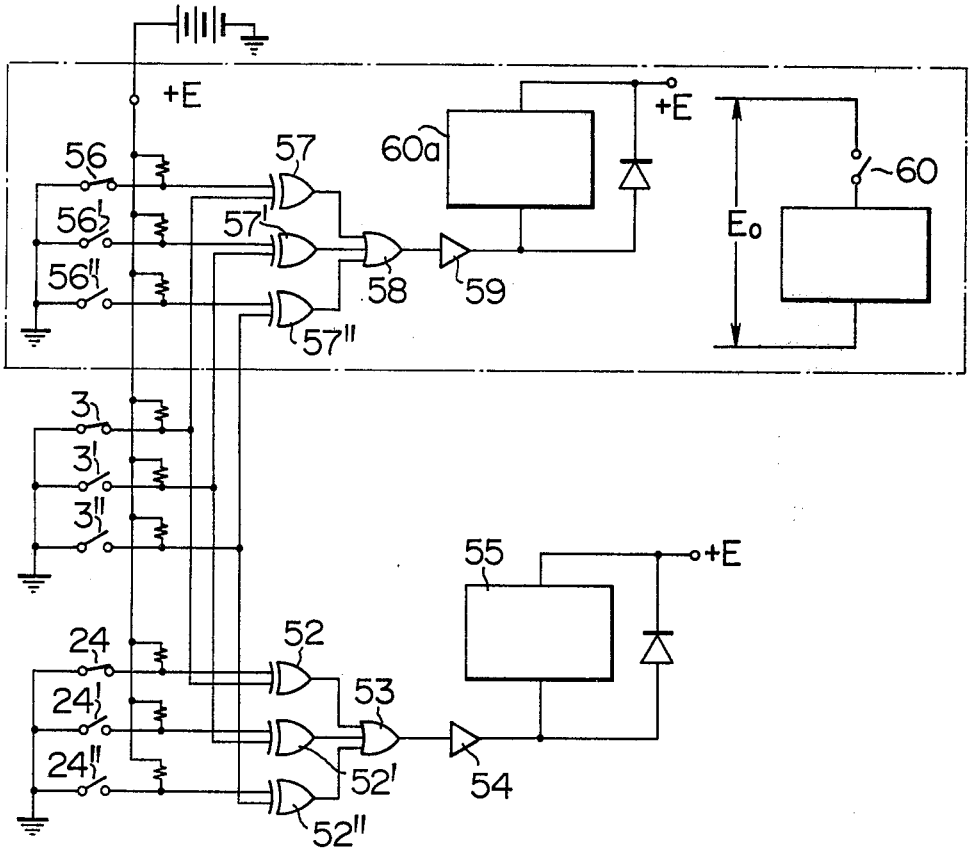
FIG. 12 is a circuit diagram showing another embodiment of the present invention.

FIG. 12 is another example of the circuit embodying the feature of the present invention. The switches 3, 3' and 3'' are connected to respective ones of OR gates 52, 52' and 52'' and similarly the switches 24, 24', 24'' are also connected with the OR gates 52, 52' and 52'', respectively. The gates 52, 52' and 52'' are in turn connected with an OR gate 53 which is connected through a buffer 54 with a solenoid 55 which corresponds to the solenoid 45*a* of the circuit in FIG. 11.

The switches 3, 3' and 3'' are further connected with OR gates 57, 57' and 57'', respectively, and the switches 56, 56' and 56'' are respectively connected with the OR gates 57, 57' and 57''. The switches 56, 56' and 56'' are the switches representing the positions of the table 32 in the paper selecting mechanism shown in FIG. 8. The OR gates 57, 57' and 57'' are connected with an OR gate 58 which is in turn connected through a buffer 59 with a solenoid 60*a*. The solenoid 60*a* is adapted to close a relay contact 60 which is connected in series with the unlocking solenoid 51 in the mechanism shown in FIG. 8.

The switches 24, 24' and 24'' are so positioned that, when the adjustable member such as the finger 6 in the mechanism shown in FIG. 4 is at a position corresponding to the position of the knob 1, the switches 24, 24' and 24'' take positions which are the same as those of the switches 3, 3' and 3''. Thus, the solenoid 55 is energized until the adjustable member reaches the desired position. The switches 56, 56' and 56'' are positioned as in the case of the switches 24, 24' and 24'' so that when the desired one of the paper rolls 30 are moved to the operative position, the solenoid 60*a* is de-energized to open the contact 60. Thus, the unlocking solenoid 51 is de-energized and the hook 35 is moved to the locking position as shown in FIG. 8.

Figure 14:
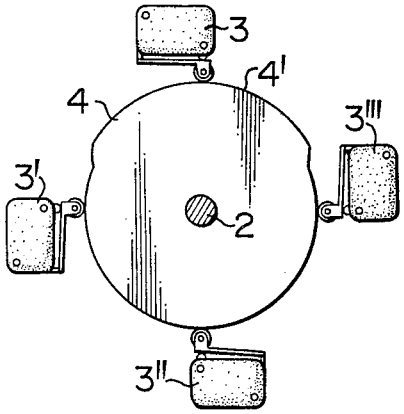
FIG. 14 is a view similar to FIGS. 2 and 3 but showing an embodiment wherein four switches are used.
Figure 13:
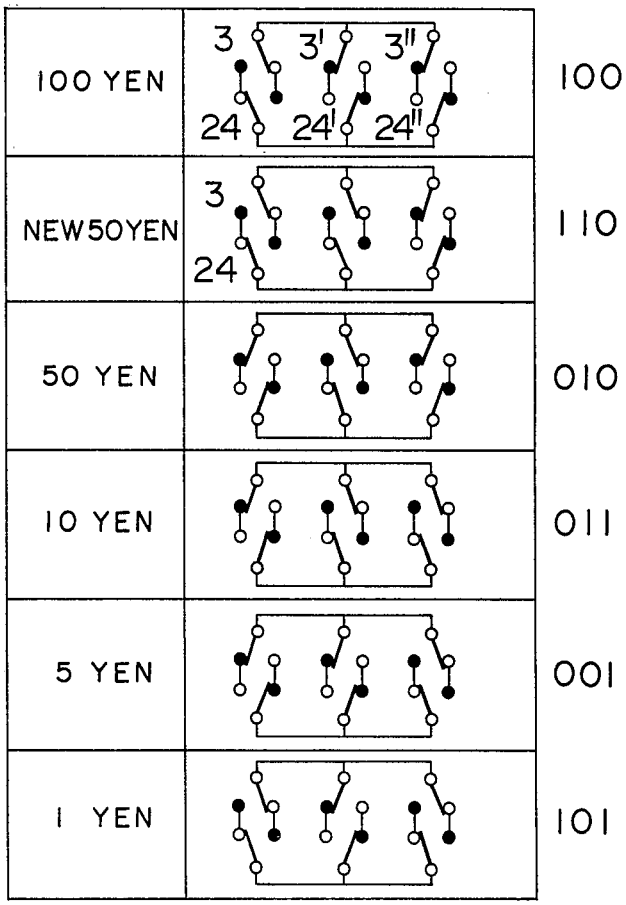
FIG. 13 shows various switch positions for different types of coins.

FIG. 13 shows the switch positions enabling selection of six positions by three switches 3, 3' and 3''. Such positions are useful in Japan because there are six types of coins currently in use. Further, if desired, four or more switches may be associated with the knob 1 as shown in FIG. 14.

The invention has thus been shown and described with reference to specific embodiments, however, it should be noted that the invention is in no way limited to the details of the illustrated arrangements but changes and modifications may be made without departing from the appended claims.

We claim:

1. Money handling machine including adjusting means for accommodating the machine to a desired type of money, said adjusting means comprising a manually operated section which includes three first switches, at least one manually operated switch actuating member having six money selecting positions and means for actuating predetermined ones of the first switches in accordance with the position of said actuating member, an operating section including at least one adjusting member which is movable to a plurality of positions, means for actuating the adjustable member for accommodating the machine to a desired type of money, second switches corresponding in number to the first switches and being so connected that the second switches co-operate with respective ones of the first switches, means for actuating predetermined ones of the second switches in accordance with the position of the adjustable member whereby a change in electrical condition is produced when the second switches take predetermined positions with respect to the first switches, said predetermined positions of the second switches being opposite to the positions taken by the respectively corresponding first switches so that lines through the first and second switches are opened when the adjustable member is moved to a position corresponding to the position of the switch actuating member.

2. Money handling machine including adjusting means for accommodating the machine to a desired type of money, said adjusting means comprising a manually operated section which includes a plurality of first switches, at least one manually operated switch actuating member having a plurality of money selecting positions and means for actuating predetermined ones of the first switches in accordance with the position of said actuating member, an operating section including at least one adjusting member which is movable to a plurality of positions, means for actuating the adjustable member for accommodating the machine to a desired type of money, second switches corresponding in number to the first switches and being so connected that the second switches co-operate with respective ones of the first switches, means for actuating predetermined ones of the second switches in accordance with the position of the adjustable member whereby a change in electrical condition is produced when the second switches take predetermined positions with respect to the first switches, said predetermined positions of the second switches being opposite to the positions taken by the respectively corresponding first switches so that lines through the first and second switches are opened when the adjustable member is moved to a position corresponding to the position of the switch actuating member, each of said first and second switches having a common terminal and a pair of switched terminals with which said common terminal is selectively connected and wherein an electrical circuit is formed by each of said first switches having its pair of switched terminals electrically connected with a pair of switched terminals of a respective second switch, the common terminals of each of said first switches being connected in common and the common terminal of each of said second switches being connected in common, said electrical circuit being serially connected with said means for actuating said adjusting member.

* * * * *